United States Patent [19]

Ferro

[11] 4,095,296

[45] Jun. 20, 1978

[54] ADJUSTABLE BED

[75] Inventor: Arthur Charles Ferro, St. Louis, Mo.

[73] Assignee: Contour Chair-Lounge Company, Inc., St. Louis, Mo.

[21] Appl. No.: 680,758

[22] Filed: Apr. 27, 1976

[51] Int. Cl.[2] ..... A61G 7/06

[52] U.S. Cl. ..... 5/69; 5/352

[58] Field of Search ..... 5/63, 66, 67, 68, 69, 5/352, 357

[56] References Cited

U.S. PATENT DOCUMENTS

| | | | |
|---|---|---|---|
| 606,247 | 6/1898 | Scribner | 5/69 |
| 1,658,776 | 2/1928 | Nixon | 5/69 |
| 3,099,843 | 8/1963 | Simon | 5/352 |
| 3,191,196 | 6/1965 | Holm | 5/69 |
| 3,644,946 | 2/1972 | Swatt | 5/69 |
| 3,965,500 | 6/1976 | Stein, Jr. | 5/68 |

*Primary Examiner*—Kenneth J. Dorner
*Attorney, Agent, or Firm*—Rogers, Eilers & Howell

[57] ABSTRACT

An adjustable bed or like furniture has a frame, a box spring with articulated base sections for different parts of the body, a box spring having a plurality of coil springs attached to each of the base sections, with framelike means to enable the box spring sections to hinge, a mattress having like sections, frame and coil springs, a single motor pivotally connected to the frame producing movement fore and aft of the bed, drive means including levers and a cable connected through the levers to elevate the head section to slant it upward toward the head end of the frame and to elevate the upper leg section to slant it upward towards the foot end of the frame, the arrangements of the springs and frames causing the box spring and mattress to follow these elevations of the sections.

15 Claims, 12 Drawing Figures

ADJUSTABLE BED

FIELD OF THE INVENTION

This invention relates to beds, chaise lounges and other devices upon which human beings can be supported, and more particularly to chairs and beds which can be adjusted to a number of positions through operation of a driving mechanism. Adjustable beds and the like known in the prior art have articulated box spring base sections which can be moved relative to the bed frame by operation of driving mechanisms. The present invention obviates the need of two driving sources, such as two motors, to elevate the box spring base sections located at the head end of the bed and at the foot end of the bed.

The present invention provides four base sections for the bed: a bottom or buttocks sections, relatively fixed, a back section pivoted to the rear of the bottom section, an upper leg section pivoted to the forward edge of the bottom section, and a foot section pivoted to the forward end of the upper section; along with actuating means, preferably power driven, to pivot the sections between a flat condition of the bed, to one wherein the back section is pivoted upwardly, the upper leg section is pivoted upwardly, and the foot section, attached to the now raised forward end of the upper leg section, is pivoted somewhat downwardly. This shape can be called "body shaped".

The bed includes a box spring, a mattress, and a drive means. The box spring base for the present device has a rigid fixed section which is fixed to the bed frame, to a head base section, an upper leg base section, and foot base section pivotally attached as aforesaid. The present invention provides power or actuating means pivotally to elevate and lower the head section, and simultaneously pivotally to elevate and lower the upper leg section and the foot section. In this, the head and foot sections pivot in one angular direction while the foot section pivots to a limited degree in the opposite direction.

Preferably the drive means is power-operated. It is a feature of this invention that the foregoing movements of the sections can be accomplished from a linear movement of a driving member, and especially by linear movement of a device moved back and forth by an electric motor.

Prior art devices such as adjustable beds also have had spring sections whose springs are distorted during the elevation process. This distortion occurs because springs that are vertical in the flat condition of the bed are squeezed together at their ends, or are spread apart at their ends, when the sections are pivoted. The present device overcomes such box spring distortion problems by the use of two wire frame members that can hold the springs in alignment despite the pivoting of adjacent bed sections. These frame members are designed so as to extend over only parts of the springs and mattress, and thereby to avoid making parts of the bed uncomfortable.

DESCRIPTION OF THE PREFERRED EMBODIMENT

Figures 1, 9, 10, 11:
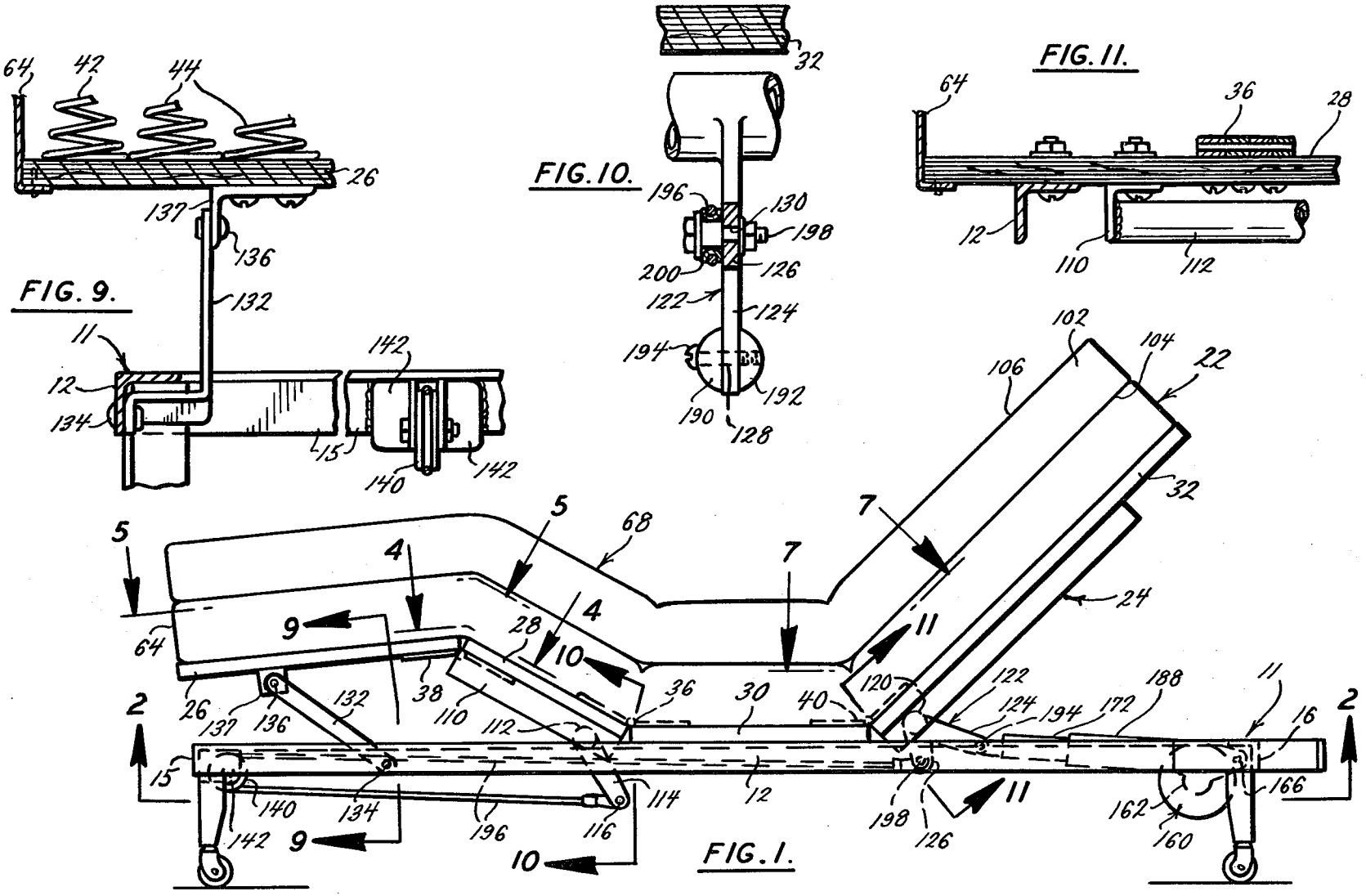
FIG. 1 is a side plan view showing the adjustable bed in an elevated position.
FIG. 9 is a transverse fractional section, partly broken, of a segment of the bed taken on the line 9—9 of FIG. 1.
FIG. 10 is a transverse fractional section of a middle segment of the bed showing the bell crank lever and the middle box spring base section, taken on the line 10—10 of FIG. 1.
FIG. 11 is a transverse fractional section of a bottom segment of the box spring taken on line 11—11 of FIG. 1.

While this invention is referred to as a bed, which is a preferred construction, it is applicable also to similar furniture such as chaise longues and the like. The bed generally designated 10, has a rigid, unitary rectangular frame 11 made up of angle irons with legs 12 depending from its corners. The frame comprises two elongated side supporting members 13 and 14, as well as a foot end member 15 and a head end member 16. The frame 11 has the horizontal flanges of the angles upward with the vertical edged downward.

An articulated box spring 22 is supported on the frame 11, in a manner to be described. It includes a base 24 made of wood or the like, in four sections 26, 28, 30 and 32. (FIGS. 1 and 2).

Figure 2:
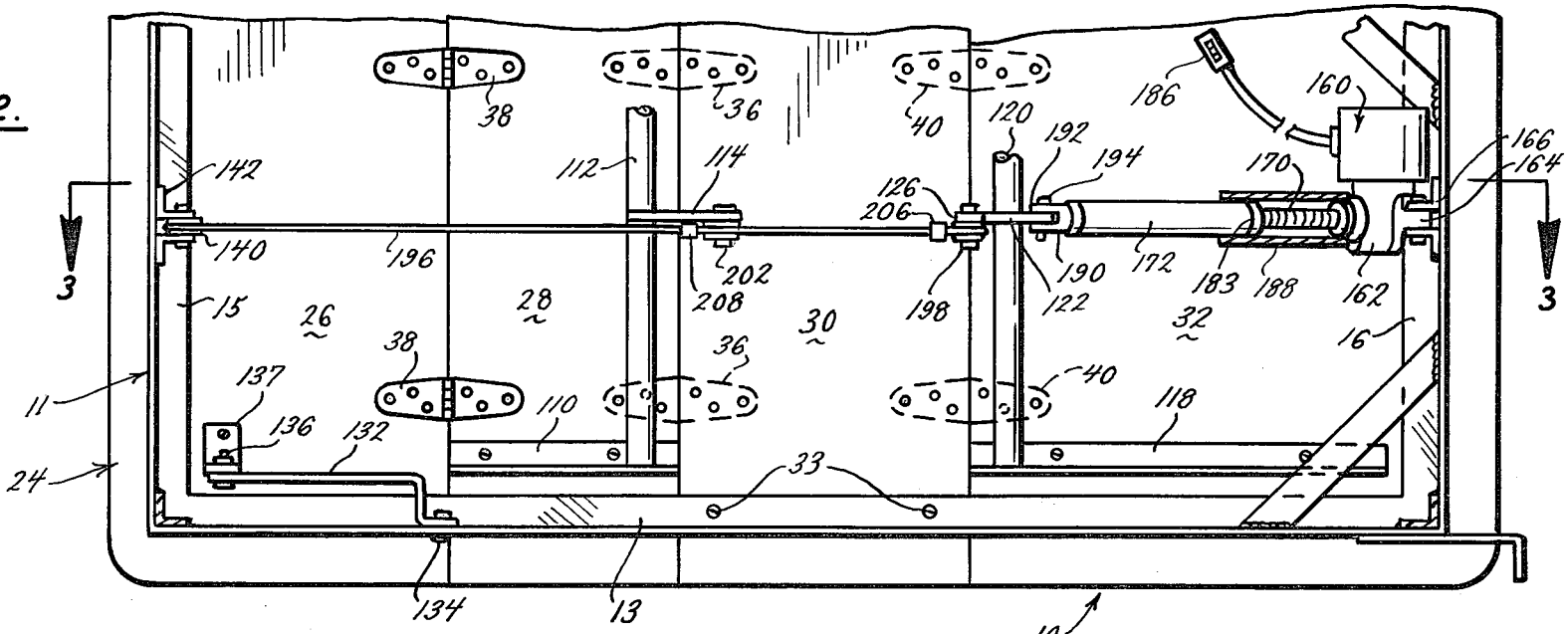
FIG. 2 is a bottom plan view partly broken, of a segment of the bed.

As seen in FIG. 2, the sections are hinged together to provide hinging in the manner indicated by the position shown in FIG. 1. To this end, the middle section 30 is secured to the frame by bolts 33. The upper leg section 28 is hinged to the middle section 30 by hinges 36 on the top surfaces to permit hinging of the upper leg secction upwardly as indicated. The lower leg or foot section 26 is hinged to the foot section of the upper leg section by hinges 38 on the bottom surfaces to enable the lower leg section to hinge downwardly as shown. The head section 32 is hinged to the head end of the middle or fixed section 30 by hinges 40 on the top surfaces to permit hinging of the sections as indicated.

Figure 5:
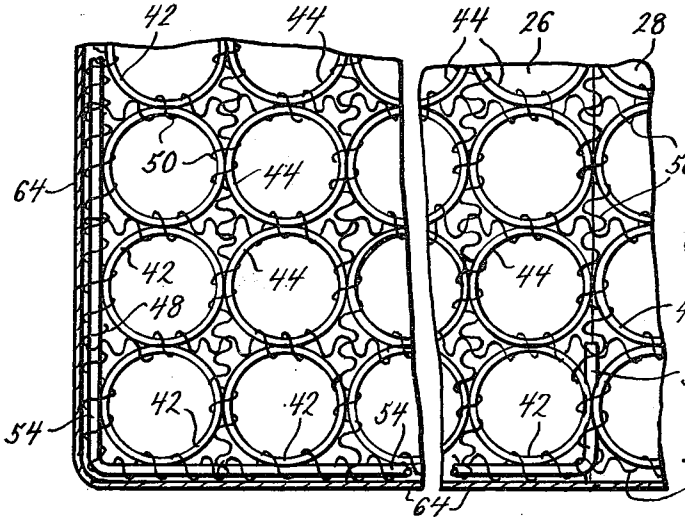
FIG. 5 is a top, fractional section partly broken of the box spring showing the foot end section and upper leg section and showing a support wire taken on the line 5—5 at the middle of FIG. 1.
Figures 3, 4, 7, 8:
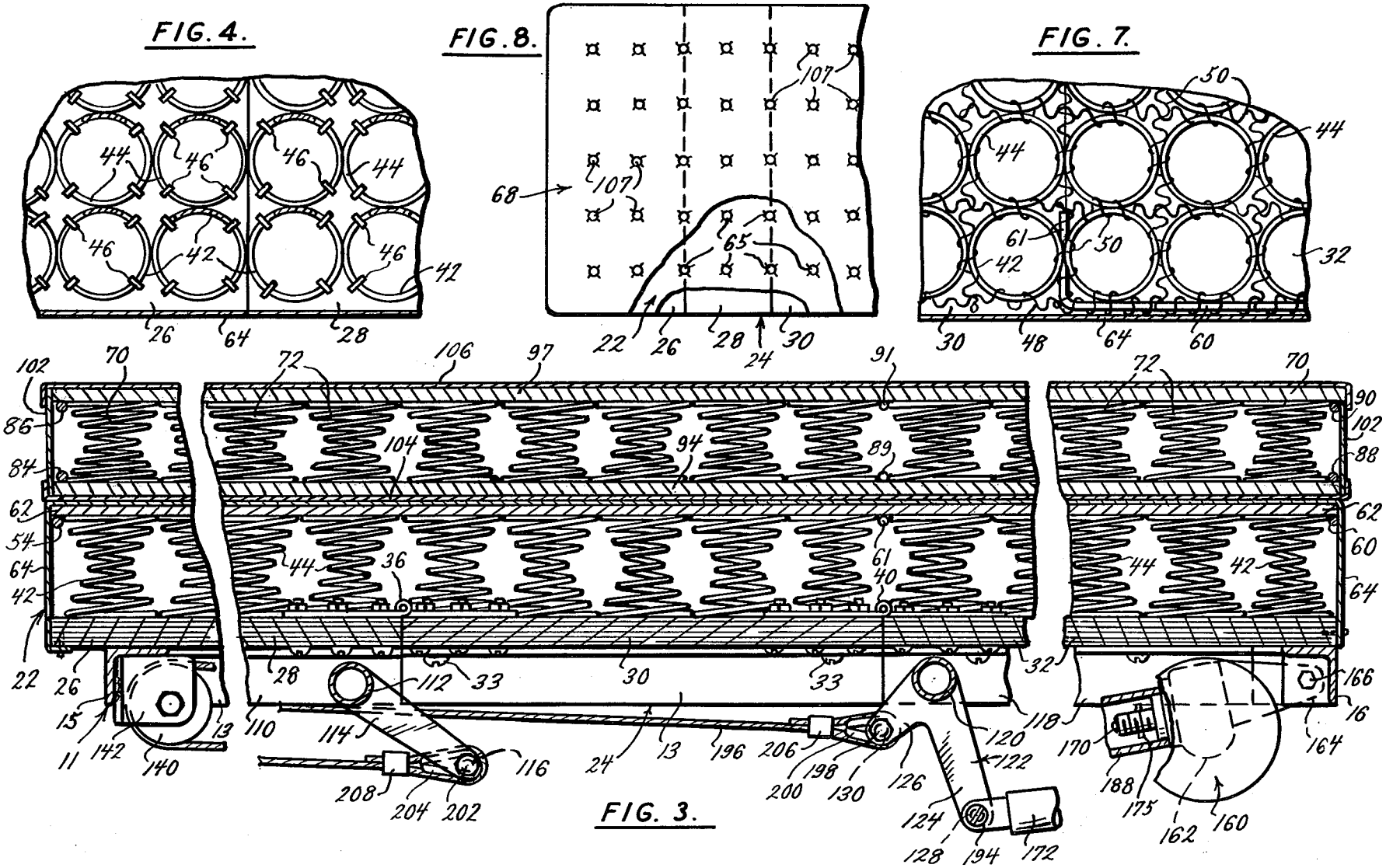
FIG. 3 is a longitudinal section, partly broken, along the line 3—3 of FIG. 2, of the adjustable bed shown in flat position, not shown the helical spring tie wires.
FIG. 4 is a top, fractional section of a segment of the box spring base at a corner of the junction of the foot end section and the upper leg section with the bed in the flat position.
FIG. 7 is a top fractional section of a segment of the box spring taken on line 7—7 of FIG. 1 showing the middle and head sections and a support wire.
FIG. 8 is a top plan view of an end segment of the bed in reduced scale, showing the alignment for the box spring and mattress tufts, and showing the location of some of the box spring base sections.

The box spring 22 has a plurality of coil springs 42 aligned around the perimeter of the base 24 (FIGS. 5 and 7). Enclosed within the perimeter springs 42 are interior coil springs 44. The coil springs 42 and 44 can have an hour glass shape, and are connected to the appropriate base sections as by staples 46 or like means that fasten down the bottom coils thereof (FIG. 4).

To stabilize perimeter springs 42, perimeter tie wire 48, which can be helically wound spring steel, extends around the perimeter of the top side of box spring 22 and resiliently engages the outer portion of each of the upper coils of perimeter springs 42 (See FIGS. 5 and 7).

Stabilization of the box spring 22 is further provided by a plurality of like longitudinal and transverse interior helical tie wires 50 which extend in a checkerboard pattern across the top of box spring 22 as shown in FIGS. 5 and 7. These interior wires 50 are attached to the upper coils of the perimeter springs 42 and interior springs 44 to resiliently engage each spring to adjacent springs as shown in FIGS. 5 and 7. The ends of interior tie wires 50 can be tied to the perimeter tie wire 48. There is a transverse tie wire 50 located directly above the junctions of sections 26 and 28, sections 28 and 30 and sections 30 and 32. The checkerboard alignment of interior tie wires 50 enables them to engage each interior spring 44 to adjacent springs at four points, and to engage each perimeter spring 42 to adjacent springs at three points, except for the corner perimeter springs which are engaged to adjacent springs at two points.

In order to minimize distortion of the box spring 22 when the base sections are adjusted, the perimeter springs 42 and interior springs 44 adjacent the junctons of the base sections are positioned so that the bottom coils of the springs 42 and 44 do not extend across the abutting edges of those sections. This positioning prevents the springs from binding against the adjacent sections when the sections are flexed. FIG. 4 shows this alignment for a segment of the base 24 at the junction of sections 26 and 28.

Figure 6:
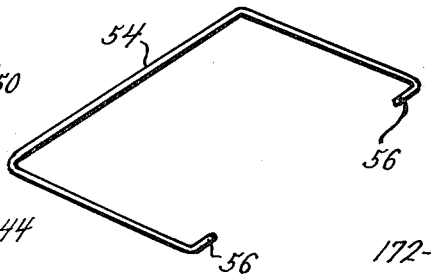
FIG. 6 is a perspective view of a support wire.

A problem of bending a mattress or box spring of the types here involved is that any bendings compresses the springs or mattress horizontally at the surface toward the center of the bending and extends these parts horizontally at the surface away from the center of bending. The present construction accommodates these two conditions. The bottom coils of all of the springs 42 and 44 being secured to the base sections, there is no problem of their being moved by bending the box spring. To secure the upper ends of the springs 42 and 44 attached to foot section 26 together, and to maintain their relative positioning, a stiff tempered metal support wire 54 is provided. The support wire 54 is generally rectangular in shape, with one side mainly open, and corresponds to the dimensions of the foot section 26 of the base. Its proximal ends are turned inwardly as at 56. A perspective view of the support wire 54 is shown in FIG. 6. The support wire 54 is secured to the exterior portion of the upper coils of the perimeter springs 42 attached to base section 26 as by passing it into the helical perimeter tie wire 48 along the perimeter of section 26 as shown in FIG. 5. The inturned ends 56 of wire 54 extend inwardly from the opposite sides of the box spring at the proximal upper edge of base section 26. The ends 56 pass through the interior helical tie wire 50 overlying the junction of sections 26 and 28 so that the inturned ends 56 overlie the edges of base sections 26 and 28. One such end 56 is shown above the junction of sections 26 and 28 in FIG. 5. The inturned ends 56, as can be seen, terminate after extending past the adjacent parts of the perimeter springs, and thereby do not cause the discomfort that would be present if they extended across the box spring. Such termination of the support wire ends is also a comfort feature of other support wires yet to be described.

By having this support wire 54 thus shaped and secured to the springs, the springs 42 and 44 are kept in vertical positions relative to the frame 11 even when the foot end of the bed is turned as shown in the elevated position of FIG. 1 in a manner that normally would tend to pull the tops of the springs toward the middle of the bed. Such pulling forces, if applied directly only to the coils at the junction of the base sections 26 and 28, could distort those springs and produce an irregularity in the box spring. The wire 54 distributes these forces over the entire section 26.

Further, the forces tend to pull the springs mounted on the base section 28 toward the foot, by an action that is the counterpart of the previously discussed one. This action cooperates with an opposite force at the joint of sections 28 and 30, so that the springs on the section 28, being pulled at their outer ends on the upper joint between sections 26 and 28, and pushed at their lower ends, tend to remain vertical relative to the frame, and not crowded into the springs on the sections 26 and 30.

The inturned ends 56 of wire 54 act somewhat like a hinge during movement of the foot end of the bed, and allows wire 54 to pivot with the bed movement, and also anchor the end of the wire 54 during such pivoting.

A like support wire 60 is provided to connect the top coils of the perimeter springs 42 which are attached to head section 32, part of the wire 60 is shown in FIG. 7. Wire 60 is also shaped like base section 32 over which it is supported. It is attached to the top coils of the perimeter springs 42 that are attached to section 32, as by passing it into the helical perimeter tie wire 48 which is attached to those coils. Support wire 60 also has its ends bent inwardly at 61 to overlie the junction of the sections 32 and 30. These ends 61, corresponding to the ends 52 of the wire 50, pass through the interior helical tie wire 50 overlying the junction of sections 30 and 32, so that the inturned ends 61 overlie the edges of those sections as shown for one inturned end 61 in FIG. 7, and the other inturned end 61 in FIG. 3. Thus the wire 60 connects all the perimeter coil springs 42 on the back section 32 together at their tops, and joins with them the perimeter coil springs attached to the corners of section 30 at the junction of sections 30 and 32.

The action of this frame wire 60 also acts to prevent distortion of the box spring. When the back is turned up, the pushing forces at the tops of the springs over the joint between the sections 30 and 32, are distributed over the tops of all the coil springs over the section 32, so that crowding at the junction of the two sections is reduced. The inturned ends 61 also act somewhat like hinges to provide a pivot for support wire 60.

A layer of conventional padding 62 covers the tops of the springs 42 and 44 of the box spring 22 (FIG. 3). The padding 62 and springs 42 and 44 can be enclosed by conventional ticking 64 or other covering material. Other conventional box spring parts can be used as is understood in the art. The padding 62 and ticking 64 at the top of the box spring 22 can have square or "biscuit" tufting 65, as shown in FIG. 8. This allows the tufts 65 to be arranged so that there is a row of tufts 65 directly overlying each of the junctions of the box spring base sections such alignment being partially shown above two base section junctions in FIG. 8, with the springs not shown in FIG. 8 for clarity. This facilitates the bending of the box spring 22 at those junctions.

A mattress 68 is supported by the box spring 22 and can have the same length and width of the box spring so that it directly overlies box spring 22 (FIGS. 3 and 8). The mattress 68 has enclosed in covering yet to be described a rectangular shaped group of perimeter coil springs 70 which extend around the perimeter of the mattress. Lying within the perimeter springs 70 are interior coil springs 72. The mattress perimeter springs 70 and interior springs 72 preferably lie directly above the corresponding perimeter springs 42 and interior springs 44 of the box spring. In the case of the mattress, which is padded on both surfaces so that it can be turned over and used with either surface up, the coil springs are connected at both their tops and bottoms by helical tie wires of spring steel, as are used at the top of the box spring coil springs.

At the bottom of the mattress helical perimeter tie wire (not shown) extends around the lower periphery of the mattress 68 and is connected to the outside of the bottom coils of perimeter springs 70 in a manner similar to that shown in FIGS. 5 and 7 for the attachment of perimeter tie wire 48 to perimeter coils 42 of the box spring 22, which the lower mattress perimeter tie wire overlies.

At the top of the mattress, above the box spring perimeter tie wire 48 and the lower mattress perimeter tie wire, the outer portions of the top coils of mattress perimeter springs 70 are likewise secured to the tops of adjacent perimeter springs 70 by helical tie wire (not shown) in the same matter as shown for perimeter tie wire 48 in FIGS. 5 and 7.

Interior helical tie wires join the mattress springs on the top and bottom sides of the mattress. At the bottom of the mattress the bottom coils of perimeter springs 70 and interior springs 72 are attached to the bottom coils of adjacent springs 70 or 72 by a plurality of transverse and longitudinal interior helical tie wires (not shown) which are aligned in checkerboard fashion similar to the alignment shown for the interior tie wires 50 of box spring 22 in FIGS. 5 and 7. These interior mattress tie wires can have their ends tied to the lower mattress perimeter tie wire. The lower mattress interior tie wires engage the bottom coils of each interior spring 72 to attach it resiliently to adjacent springs 70 or 72 at four points, and attach the perimeter springs 70 at three points to adjacent springs, except for the perimeter springs 70 located at the mattress corners which are attached at two points to adjacent springs. As in the case of the box spring interior tie wires 50 shown in FIGS. 5 and 7, there is a lower mattress transverse interior wire located directly above the junctions of sections 26 and 28, section 28 and 30, and sections 30 and 32.

At the top of the mattress above the box spring interior tie wires 50 and the lower mattress interior tie wires, like transverse and longitudinal interior helical tie wires (not shown) are attached to the upper coils of mattress interior springs 72 and perimeter springs 70. The upper interior tie wires are aligned in a checkerboard fashion similar to the alignment shown for the box spring interior tie wires 50 in FIGS. 5 and 7, and engage the upper coils of each mattress interior spring 72 to resiliently engage each to adjacent springs at four points, while perimeter springs 70 are engaged to resiliently engage each of them at three points to adjacent springs, except for the corner perimeter springs which are attached at two points to adjacent perimeter springs. As in the case of box spring tie wire 50 shown in FIGS. 5 and 7, there is an upper mattress transverse tie wire located directly above the junctions of sections 26 and 28, sections 28 and 30, and 30 and 32.

To stabilize the mattress 68 during flexion, the mattress 68 has four stiff tempered support wires.

Beginning with the first of these four wires, at the lower foot end of the mattress 68 above base section 26 of the box spring, a stiff tempered support wire 84 is provided to connect the bottom coils of the mattress perimeter springs 70 which are located above the box spring base section 26. The support wire 84, like box spring support wire 54 shown in FIG. 6, is generally rectangular in shape with inturned ends like the inturned ends 56 of wire 54, and corresponds in dimensions to the foot base section 26 over which it extends. It is attached to the exterior of the bottom coils of the perimeter springs 70 overlying section 26 by passing it into the lower mattress perimeter tie wire. FIG. 3 shows the wire 84 in section. The inturned ends of support wire 84 overlie the junctions of sections 26 and 28 in a fashion similar to that shown in FIG. 5 for support wire 54. The inturned ends of support wire 84 are joined to the bottom coils of the perimeter springs 70 located above the corners of sections 26 and 28 at the junction of those sections by the lower mattress interior tie wire which extends above the junction of base sections 26 and 28, so that the inturned ends overlie the edges of sections 26 and 28. Thus the wire 84 connects all the mattress perimeter coil springs 70 located above section 26 together at their bottoms, and joins with them the two perimeter springs 70 located above the corners of section 28 adjacent the junction of sections 26 and 28.

At the top of the foot end of mattress 68 directly above support wire 84 lies a like support wire 86 having a generally rectangular shape like that of wire 84. It is connected to the upper ends of the springs just as the support wire 54 is connected.

At the other end of the mattress, at the bottom of the head end, a third mattress support wire 88 having the general shape of the box spring support wire 60 beneath it is provided to connect the exterior of the bottom coils of the mattress perimeter springs 70 located directly above head section 32 of the base, and is attached to these coils as by passing through the bottom mattress helical perimeter tie wire. Support wire 88 has inwardly turned ends 89, corresponding to the inwardly turned ends 61 of support wire 60, which pass through the lower mattress interior helical tie wire which overlies the junction of sections 30 and 32, so that they are secured to the bottom coils of the perimeter springs 70 located above the corners of base sections 30 and 32 at the junction of those sections. The ends 89 of wire 88 thus overlie the inwardly turned ends 61 of the box spring support wire 60 directly beneath it, and also overlie the junction of sections 30 and 32, as shown for one inturned end 89 in FIG. 3.

Finally, at the top of the head end of the mattress directly above support wire 88 is an identically shaped support wire 90 which is attached to the periphery of the top coils of the same perimeter springs 70 to which support wire 88 is secured, in the manner heretofore discussed. The inwardly turned ends 91 of wire 90 thus lie directly above the inwardly turned ends 89 of support wire 88 (FIG. 3).

The aforementioned helical tie wires and support wires all act together to prevent distortion of the bed during its flexion and extension.

The mattress 68 can have a layer of padding 94 located below the mattress springs 70 and 72, and layer 97 located above the mattress springs.

Conventional border material 102 can be provided around the sides of mattress 68. A layer of ticking 104 or other conventional cover material can be provided beneath padding 94 and secured to the bottom edge of border 102, while another layer of conventional ticking or the like 106 can lie above padding layer 97 and be attached to the top edge of border 102 so that the ticking layers 104 and 106 act with border 102 to enclose mattress 68. The padding 94 and ticking 104 on the bottom side of the mattress, and the padding 97 and ticking 106 on the top side of the mattress are each provided with square or "biscuit" tufts. The tufts 107 are shown for the top side of the mattress in FIG. 8. This type of tufting permits the tufting to be arranged so that there is a row of tufts 107 on the mattress top and a row of tufts on the mattress bottom (not shown) aligned directly above each of the junctions of the box spring base sections. Such tufting alignment facilitates bending of the mattress 68 above those box spring base section junctions. Other conventional mattress parts can be used as is understood in the art.

In order to adjust the several baseboard sections, pivoting actuating means are provided. Two angle bars 110 are attached as by bolts to the bottom of section 28 in parallel positions, with their horizontal flanges pointing towards one another. One such bar 110 is shown in FIG. 2. The vertical flanges of the angle bars 70 are connected as by welding to the ends of a metal tube 112 which can extend perpendicularly to the angles 70. Depending from tube 112 is a rigidly attached lever arm 114. A bore 116 can extend through the lower end of lever 114.

Similarly, to the bottom of section 32 angle bars 118 are secured in parallel but reverse positions as by bolts, and have their vertical flanges rigidly connected by tube 120 which extends perpendicularly to the angles 118. Depending from tube 120 is a rigidly attached bell crank lever 122 having a long arm 124 and a short arm 126. Long arm 124 has a bore 128 near its bottom end, while short arm 126 has a bore 130 near its bottom end (FIG. 10).

Means are also provided to elevate the foot end of the foot section 26 when the base sections 28 and 32 are elevated. Two support rods 132 are pivotally connected as by rivets or bolts 134 to the vertical flanges of each of the side members 13 and 14, as seen in FIG. 2 for one support rod 132. The other ends of rods 132 are pivotally connected as by bolts or rivets 136 engaging in brackets 137 secured to the bottom side of section 26. A pulley 140 is attached at the middle of the top frame member 15 by a bracket 142, for a purpose to appear.

In order to move the various baseboard sections, a power means is provided. Mounted on the head end 16 of the frame 11 is a reversible AC motor 160 of appropriate size. The casing of the motor 160 has a housing extension 162. Extending rightwardly (as seen in FIG. 2) from housing extension 162 is a pivoting lug 164 having an annular bore permitting it to be pivotally secured to head end frame member 16 at 166 as by a bracket and bolts.

Housing extension 162 has a transmission which enables it to rotably drive a threaded drive shaft 170 at an appropriate speed. The gearing is irreversible so that the parts will be held in any position to which they are moved by the motor. Shaft 170 extends leftwardly from housing extension 162 (in the drawings) into a cylindrical drive tube 172. A pin 174 extends through and is secured to the shaft 170 adjacent the left end of the threaded portion while pin 175 extends through and is secured to the shaft 170 adjacent the right end of the threaded portion as shown in FIG. 12.

Means are provided to allow the rotary movement of shaft 170 to cause linear movement of the drive tube 172 relative to the shaft. The action enables the motor to displace the drive tube 172 to an extreme in either direction, and thereafter to "free wheel", i.e., continue rotating without driving the tube. This is a commercially available drive mechanism. Partially enclosed within the right end (as viewed in FIG. 2) of drive tube 172 can be a rider assembly mechanism 176 having a structure similar to that shown in U.S. Pat. No. 3,232,575. The rider assembly 176 operates as described in said patent and the specification of said patent is incorporated by reference herein. The rider assembly 176 has an interior ring 178 and an end ring 180. A sleeve 181 extends within the two rings 178 and 180. A leaf spring 182 can be positioned between the rings 178 and 180 as disclosed in the incorporated patent.

Figure 12:
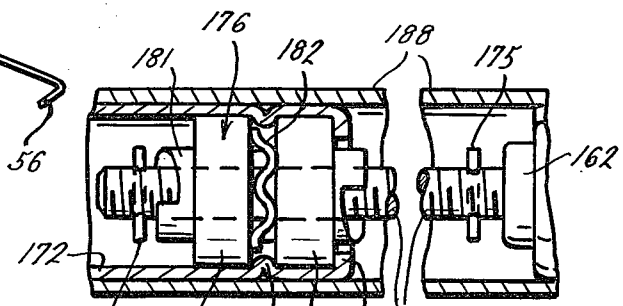
FIG. 12 is a plan view, partly in section, of the rider assembly shown enclosed within the drive tube and protective tube.

To hold rider assembly 176 within the right end of drive tube 172 of the present device an annular V shaped detent 183 is crimped into drive tube 172 to extend from the interior wall of drive tube 172 between the two rings 178 and 180 (FIG. 12). The end 184 of the tube 172 is crimped at the right end of drive tube 132 to abut the right side of the ring 180, and thus acts with detent 183 to sandwich ring 180 holding it and the rider assembly 176 within tube 132.

The shaft pins 174 and 175 act as disclosed in the incorporated patent to disengage the drive of the shaft 170 from drive tube 172 when they strike the shoulders of sleeve 181.

The motor 160 can be operated by a standard three position switch 186, so that the drive shaft 170 can be rotated in either direction about its axis or can be stopped in a locked position. Switch 186 can have a cord of sufficient length to enable a person lying in the bed to operate the motor.

To prevent exposure of drive shaft 170 a cylindrical protective tube 188 is connected to motor extension 162. Drive tube 172 slidingly telescopes into protective tube 146 to permit movement of drive tube 172 within protective tube 146 and to enclose the drive shaft 170 during such movement. This prevents bed clothing and other articles to become caught in the movements of these parts.

To enable the motor 160 to power the pivoting actuating means, the left end of drive tube 172 is slotted to form two connection fingers 190 and 192. The fingers 190 and 192 have aligned circular bores, which can be aligned with bore 128 of the long bell lever arm 124, so that the fingers 190 and 192, and arm 84 can be connected as by a bolt 194 (FIGS. 3 and 10).

A cable 196, which can be made of stainless steel, is supplied to transfer pivoting force from bell crank lever 122 to lever arm 114. In order to secure the cable 196 as will be described, a bolt 198 is passed through bore 130 of short bell crank lever arm 126, and with a nut and washer pivotally secures a grooved U brace 200 to the side of arm 126. Likewise a bolt 202 passes through bore 116 of lever arm 114 and with a nut and washer pivotally secures a grooved U brace 204 to the side of lever arm 114. One end of cable 196 is then looped around U brace 200 at bell crank lever arm 126 and secured to itself as by a clamp 206. From its connection to bell crank lever arm 126 cable 196 extends toward the foot end of the bed, passes beneath tube 112, loops around pulley 140, and is directed back toward the right end of the bed where it loops around U brace 200 and is finally secured to itself by clamp 208.

Thus means have been provided to pivotally raise and lower the box spring and mattress through operation of a single motor, and to prevent distortion of the box spring and mattress during the process.

OPERATION

A person desiring to use the adjustable bed 10 can lie on the mattress 68 when the bed 10 is, for example, in a level position as it is shown in FIG. 2 and FIG. 3, so that his head and feet are at the appropriate ends, as in a standard flat bed, with his body being fully supported by the box spring 22 and the mattress 68.

If the occupant desires to elevate the adjustable bed he can do so by positioning the switch 186, which can be at his side, to the "up" position. This positioning of the switch causes the motor 160 to rotate the threaded drive shaft 170 so that the shaft interacts with the rider assembly 176 to pull drive tube 172 along the axis of the shaft 170 upward and towards the head end of the bed.

During the movement of the shaft 170 and drive tube 172 which occurs during the elevation and also the lowering of the bed, as will be described, the pivot lug 164 permits the motor 160 to pivot about its connection at 166 to the head end frame member 16, to accomodate the movement of the shaft and drive tube, and prevent both mechanical and electrical injury to the components of the adjustable bed 10. Also, during the movement of the drive shaft 170 into and out of the drive tube 172, the drive tube 172 slides within the protective tube 188 as the protective tube moves with the motor 160. The protective tube 188 thus acts with drive tube 172 to enclose drive shaft 170 during the elevation and lowering of the bed 10 thereby preventing foreign matter from coming in contact with the shaft 170 or rider assembly 176 and interfering with their operation.

By virtue of the pivotal connection of drive tube 172 to the bottom of bell crank lever arm 124 by bolt 194, the rightward and upward movement of drive tube 172 in turn pulls the foot of bell crank lever arm 124 upward and rightward, thereby acting through the connection of bell crank lever 122 to connecting tube 120 to lift and rotate connecting tube 120 counterclockwise (as seen viewing FIG. 1) about the connection hinges 40. This movement of connection tube 120 acts through the connection of connection tube 120 to angle bars 118 to pivot the angle bars 118 counterclockwise about hinges 40, and this acts to pivot the head base section 32 about hinges 40 in a counterclockwise direction. The elevation of box spring base section 32 relative to the bed frame 11 likewise elevates the portion of the mattress 68 lying above box spring section 32, and thereby elevates the upper portion of the occupant's body. Base section 30, being firmly attached to the frame, remains stationary during this movement.

The elevation of box spring section 28 occurs simultaneously with the elevation of section 32. The rightward pull of drive tube 172 acts through its connection to bell crank lever 122 to pull the foot of the short bell crank lever arm 126 towards the head end of the bed. This pull on the short bell crank lever arm 126 is transferred through the cable 196 pivotally attached to its bottom, around pulley 140 to the bottom of lever arm 114 to which cable 196 is pivotally connected, and causes the bottom of lever arm 114 to be pulled towards the foot end of the bed. This leftward pull against lever arm 114 which is secured to connecting tube 112 is transmitted to lift and rotate connecting tube 112 clockwise about the hinges 36 which connect base section 28 to base section 30, and rotate the angle bars 110, to which connection tube 112 is secured, in a clockwise direction relative to the hinges 36 (as seen in FIG. 1). The rotation of the angle bars 110 acts to pivot box spring base section 28 clockwise about connecting hinges 36, to elevate it as shown in FIG. 1 and the section of mattress 68 located above it, thereby elevating the upper legs of the occupant. Box spring section 30 remains stationary relative to the frame during the movement of base section 28.

As section 28 pivots upward, its foot end edge lifts the inner edge of section 26 upward, as the two sections pivot about the hinges 38 connecting those edges. As the inner edge of section 26 is lifted upward and towards the head end of the bed, the support arms 132 pivot clockwise about their connections by rivets 134 to side frame members 13 and 14, and extend above the frame 11 to lift foot end section 26 upward and to provide support for section 26. The movement of the forward end of the foot section 26 includes arcuate movement of the pivots 136 about the axis of the pivots 134. Since the arms 132 have a length less than the front-to-rear dimension of the base section 28, the pivots 136 will not move up as far as the hinges 38. This gives a comfortable down slope toward the foot, for the section 26. The elevation of box spring base section 26 elevates the section of the mattress 68 positioned above box spring section 26 and thereby elevates the lower legs and feet of the occupant.

When the adjustable bed is elevated to the position the occupant desires, the occupant can position the switch 186 to the "off" position to cause an immediate cessation of the rotation of shaft 170 to lock it and hold drive tube 172 motionless. The drive through the motor gearing and drive tube 172 being irreversible, stopping the motor in turn locks bell crank lever 122 into position. Bell crank lever 122, by vitue of its rigid connection to connecting tube 120, and the angle bars 118 causes the base section 32 to be held in adjusted position. The portion of the mattress 68 above box spring base section 32 is thus locked into position. The locking of bell crank lever 122 into position also holds cable 196, which is connected to bell crank lever arm 126, taut, and thereby prevents the weight of the mattress 68 above base sections 28 and 26, the body weight on that mattress portion, and the weight of the box spring 22 above base sections 28 and 26 from pushing base section 28 downward. The bed can thus be elevated to a number of positions, one such position being shown in FIG. 1.

The foregoing power driven operation of the bed is preferred. It will be seen that a linear, or at least substantially linear, movement of the member 172 causes the action to occur. Manual force applied to the member 172, or to the bell crank, or other associated parts, can cause the foregoing operation to occur in cases where power is not available. The irreversible motor drive constitutes holding means to retain the parts in selected elevated positions, and some such retaining means is required.

When the occupant desires to lower the bed 10 from an elevated position, he can position the switch 186 to the "down" position so that the motor 160 will rotate the drive shaft 170 in a direction opposite to that of the shaft 170 rotation when the switch 186 is in the "up". This reverse rotation of the shaft 170 acts through the rider assembly 176 to push the drive tube through protective tube 188 towards the foot end of the bed 10. During this movement the motor pivot lug 164 permits the motor 160 to accomodate this movement by pivoting at its connection by a bolt and bracket to right end frame member 16.

The pushing of drive tube 172 towards the foot end of the bed 10 in turn pushes the bottom end of bell crank lever arm 124 which is connected to drive tube 172 downward and towards the foot end of the bed.

This push against bell crank lever arm 124 acts through the connection of bell crank lever 122 to connection tube 120 to pivot angles 118 and box spring base section 32 about connection hinges 40 in a clockwise rotation to lower the part of the mattress 68 above base section 32 and thereby lower the upper portion of the body of the occupant.

The lowering of box spring base section 28 occurs simultaneously with that of head base section 32. The leftward push of drive tube 172 moves the bottom of the bell crank lever arm 126 towards the foot end of the bed 10. This movement of the bottom of the bell crank lever arm 126 releases the tension in the cable 196 attached to the bottom of bell crank lever arm 126. The weight on the sections 26 and 28 causes them to move down as the cable slackens, and will continue until a lower position is reached and the motor is stopped, or until the bed is again flat.

If the switch 186 is held in the "down" position after the adjustable bed 10 is returned to the level position the pin 174 of shaft 170 engages the left shoulder of the sleeve 181 so that the rider assembly 176 acts to disengage the drive of the shaft 170 from the drive tube 172. This permits the drive shaft 170 to continue to rotate without exerting a drive force against drive tube 172, thus preventing injury both electrically and mechanically. Likewise, when the switch 186 is held in the "up" position after maximum bed elevation, the pin 175 at the right end of shaft 170 engages the right shoulder of sleeve 181 to disengage the drive of the shaft 170 from the drive tube 172.

Thus the adjustable bed 10 can be operated by a single motor to elevate the torso and head, and also to elevate the upper legs while giving a combination of elevation and down slope to the legs and feet.

During elevation of the bed the foot section 26 as viewed in FIG. 1 pivots counterclockwise about the forward end of the upper leg section 28. This tends to put a spreading force on the tops of the springs 42 and 44 adjacent the pivotal junction between the two sections 26 and 28. In this same movement the upper leg section 28 is pivoting about the fixed section 30 in an opposite angular movement that tends to compress the tops of the springs 42 and 44 at that junction line, together.

All the springs in the box spring itself are stapled down to the plywood base portions so that they cannot be displaced during this pivoting action. The top sections are held together resiliently by the various helical wires such as 48 and 50.

In order to prevent the stretching of the top coils of the springs in the foot section during the pivoting action, and particularly those adjacent the pivot line, the wire spring frame member 54 is present. It is connected to all of the peripheral springs; and its inner ends over the pivot line extend inwardly to be connected to the coils of the peripheral springs along the pivot line. The support wire frame 54 then distributes the load of the distorting forces over the pivot line to all of the peripheral springs in the foot section 26, thereby preventing undue distortion of the top coils of the springs adjacent that pivot line. In this the inturned ends 56 of the support wire 54 act somewhat like a hinge, and provide a pivot which facilitates the bending at the junction of base sections 26 and 28, as well as anchoring wire 54.

In this action the spreading force also causes pulling to be applied to the upper coils of the springs at the forward end of the upper leg section 28 because these springs are also fastened together and to the springs over the foot section 26. This force is aided by the squeezing force at the pivot line between the sections 28 and 30. Pivoting at that line produces forces on the upper coils of the springs on the two pivoted sections, tending to squeeze them together; and distortion might occur, particularly on the coils nearest the pivot line, were it not for the fact that the stretching force caused along the pivot line of the sections 26 and 28 draws these coils forward or toward the foot. Consequently the springs all tend to remain vertical and there is no buckling. Yet the stiff wire frame 54 extends over only the foot part of the three sections and so minimizes making the edge of the box spring more rigid.

The action in the mattress is substantially the same except that because the springs are not secured at the bottom, as are the springs of the box springs secured to the plywood bases, the wire frames 84 and 86 are provided in the forward section or foot section of the mattress at the tops and bottoms of the springs.

At the pivot line between the bottom base section 30 and the back section 32 the crowding, when pivoting occurs to raise the back section, is at the top coils. In this case the support wire frame member 60 is secured between the top coils of the springs over the pivot line and extends around and is connected to all of the peripheral springs in the back section 32. The squeezing force is thus distributed over the entire set of peripheral springs in the back section so that these coils are all pushed upwardly causing the distortion of the springs on the back section to be reduced.

The same action occurs in the mattress at this back section it being noted again that there are wire frame members at the top and the bottom of the section of the mattress because the lower coils of the springs are not secured to a base member as in the box spring.

Thus by this arrangement there can be no bunching of the springs at the pivot lines which would distort the bed and give it humps and ridges. Yet this is done with a minimum of metal framing so that the mattress remains comfortable.

It is to be understood that the foregoing description and the accompanying drawings have been given by way of illustration and example. It is also to be understood that changes in form of the elements, rearrangement of parts, and substitution of equivalent elements, which will be obvious to those skilled in the art, are contemplated as within the scope of the present invention which is limited only by the claims which follow.

I claim:

1. An adjustable bed comprising a support and an articulated base; the base including a first section having a back edge and a foot edge, said first section being secured to the support so as to be immovable thereon; a second back section pivoted to the back edge of the first section so as to vary its angle relatively to the first section, a third section having a foot end and back edge, said third section back edge being pivoted to the foot edge of the first section so as to vary its angle relatively to the first section; and actuating means connected to the second and third sections to pivot the second section and third section up relatively to the first section simultaneously by a movement thereof comprising a first lever attached to the second section, a second lever attached to the third section, means to cause movement of the first lever to move the second lever including a linkage cable connected to the first lever and extending in a first direction from the first lever toward the foot end past the second lever to sliding engagement with the support and thence extending in a second direction substantially opposite to the said first direction to the second lever and connected to the second lever.

2. The structure of claim 1 wherein the actuating means further comprises a power mechanism pivotally attached to the support having a shaft with means to be connected to drive the first lever.

3. The structure of claim 1 with a fourth section pivoted to the foot end of the third section, and means in the actuating means to pivot the fourth section about the foot end of the third section simultaneously with movement of the third section including a rigid member pivotally attached to the fourth section and pivotally attached to the support.

4. An adjustable bed comprising a support and an articulated base, the base comprising a first section having a back edge and a foot edge, said first section being secured to the support so as to be immovable thereon; a second back section pivoted to the back edge of the first section so as to vary its angle relatively to the first section, a third section having a foot end and back edge, said third section back edge being pivoted to the foot edge of the first section so as to vary its angle relatively to the first section, means for pivoting the second and third sections up relatively to the first section comprising a first lever rigidly attached to the second section to be integral and immovable therewith to pivot the second section, a second lever rigidly attached to the third section to be integral and immovable therewith to pivot the third section, and comprising elongated linkage engaged to the first and to the second levers so that counter clockwise movement of one lever pivots that section to which it is integrally connected and transfers force through the linkage to cause clockwise movement of the other lever and that section to which said other lever is integrally connected.

5. The structure of claim 4 with a fourth section pivoted to the foot end of the third section, and means to pivot the fourth section about the edge of the third section simultaneously with movement of the third section including means attached to the fourth section and attached to the support.

6. The structure of claim 5 wherein the means to pivot includes a rod pivotally attached to the fourth section and pivotally attached to the support.

7. The structure of claim 4 wherein the linkage connecting the levers is a cable.

8. The structure of claim 4 wherein the length of the first lever is different from the length of the second lever so that the pivotal movement of the second section by the first lever is of a different magnitude than the pivotal movement of the third section by the second lever.

9. The structure of claim 4 wherein the first lever is of shorter length than the second lever so that movement of the first lever pivots the second section through a larger angle than the angle the third section is pivoted by the second lever.

10. The structure of claim 4 further comprising a motor engaged to the support with the motor shaft engaged to the first lever to move the same to pivot the second section.

11. The structure of claim 4 further comprising a power mechanism engaged to the support and engaged to the second section to pivot the second section.

12. An adjustable bed comprising a support and an articulated base, the base comprising a first section having a back edge and a foot edge, said first section being secured to the support so as to be immovable thereon; a second back section pivoted to the back edge of the first section so as to vary its angle relatively to the first section, a third section having a foot end and back edge, said third section back edge being pivoted to the foot edge of the first section so as to vary its angle relatively to the first section, means for pivoting the second and third sections up relative to the first section comprising a first lever rigidly attached to the second section to be integral therewith to pivot the second section, a second lever rigidly attached to the third section to be integral therewith to pivot the third section, and further comprising a pulley secured to the support toward the foot end of the second lever and linkage comprising a cable connected to the first lever that extends in a first direction from the first lever to the pulley and around the pulley and extends from the pulley in a second direction substantially opposite the said first direction to engagement with the second lever.

13. An adjustable bed comprising a support having a head end and an articulated base; the base comprising a first section having a back edge and a foot edge, said first section being secured to the support so as to be immovable thereon; a second back section pivoted to the back edge of the first section so as to vary its angle relatively to the first section, a third section having a foot end and back edge, said third section back edge being pivoted to the foot edge on the first section so as to vary its angle relatively to the first section; means to rigidly attach a first lever to the second section so as to be integral therewith so that movement of the first lever can pivot the second section, a power mechanism having an extendable member, said power member being connected to the support head end and pivotally connected to the first lever so that the power mechanism can be extended and contracted to pivot the second section; means to rigidly attach a second lever to the third section so as to be integral therewith so that movement of the second lever can pivot the third section;

and a linkage cable connected to the first lever and extending therefrom in a first direction toward the foot end past the second lever to engagement with the support and thence extending in a second direction substantially opposite to the first direction toward the second lever and connected to the second lever.

14. The structure of claim 13 wherein the means to rigidly attach the first lever comprises a pair of bars extending longitudinally to the second section and rigidly secured thereto, and a transverse rod connected to the longitudinal bars, said first lever being secured to the transverse rod.

15. The structure of claim 13 wherein the means to rigidly attach the second lever comprises a pair of bars extending longitudinally to the third section and rigidly secured thereto, and a transverse rod connected to the longitudinal bars, said second lever being secured to the transverse rod.

* * * * *